United States Patent [19]

Rothman et al.

[11] 4,111,600

[45] Sep. 5, 1978

[54] BREAKAWAY FAN BLADE

[75] Inventors: Edward A. Rothman, South Glastonbury; Charles E. K. Carlson, Manchester, both of Conn.

[73] Assignee: United Technologies Corporation, Hartford, Conn.

[21] Appl. No.: 749,133

[22] Filed: Dec. 9, 1976

[51] Int. Cl.[2] ..... F01D 5/28

[52] U.S. Cl. ..... 416/2; 416/224

[58] Field of Search ..... 416/2, 224, 226, 241 A; 415/9, 214

[56] References Cited

U.S. PATENT DOCUMENTS

| | | | |
|---|---|---|---|
| 2,312,219 | 2/1943 | Sensenich | 416/224 |
| 2,383,342 | 8/1945 | Riley | 416/229 |
| 2,648,388 | 8/1953 | Haines et al. | 416/229 |
| 2,767,461 | 10/1956 | Lebold et al. | 416/229 |
| 2,981,337 | 4/1961 | Stuart | 416/226 |
| 3,144,349 | 8/1964 | Swingler et al. | 416/229 X |
| 3,484,174 | 12/1969 | McCoubrey | 416/241 A X |
| 3,784,322 | 1/1974 | Erich et al. | 416/229 |
| 4,006,999 | 2/1977 | Brantley et al. | 416/224 |
| 4,022,540 | 5/1977 | Young | 416/2 X |

*Primary Examiner*—Everette A. Powell, Jr.

*Attorney, Agent, or Firm*—Charles A. Warren

[57] ABSTRACT

A fan blade having a breakaway leading edge positioned on the spar and shell that constitute the main structure of the blade, the leading edge being adapted to break away, in part at least, upon being struck by a large foreign object, with the shell providing an acceptable leading edge after the breakaway.

7 Claims, 2 Drawing Figures

BREAKAWAY FAN BLADE

BACKGROUND OF THE INVENTION

Fan blades are subject to damage particularly on the leading edge in the event of impact by foreign objects, with resultant damage to the effectiveness of the leading edge and thus to the functioning of the blade. Small foreign objects may do little damage but large objects may damage the blade so much as to require engine shutdown, and may break away such a piece of the blade as to cause serious engine damage when ingested. It is desirable to have a blade construction in which the damage to the blade may be limited and in which the damaged blade may still be operable.

SUMMARY OF THE INVENTION

One feature of the invention is a blade construction in which the main structure of the blade has a breakaway leading edge mounted thereon, this leading edge having a predetermined frangibility, greater than that of the main structure. Another feature is a secondary leading edge, exposed when the breakaway leading edge is damaged which provides an adequate aerodynamic shape for continued functioning of the blade. Another feature is a fan blade leading edge with controlled breakaway locations so as to control the extent of damage to the blade in the event of impact with a foreign object, with this leading edge of more frangible material than the main blade structure.

According to the invention, the blade which is made up of a spar and a shell mounted thereon and forming an acceptable airfoil, with the trailing edge portion forming the finished blade contour, and with the leading edge portion located inwardly of the preferred leading edge location to receive thereon a breakaway leading edge portion cooperating with the remainder of the shell to form the desired blade airfoil shape. This breakaway leading edge is more breakable than the shell and is secured to the shell so that in the event of foreign object impact near the leading edge, a length of this breakaway structure will break from the remainder or separate from the shell without damage to the shell.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 2:
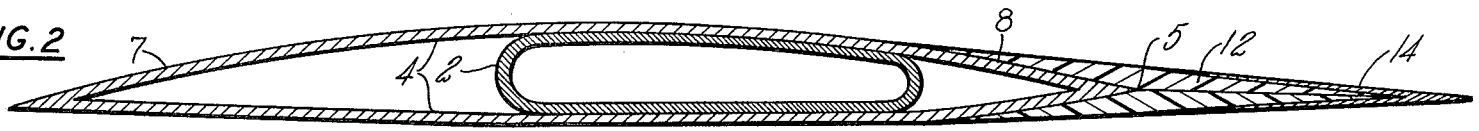
FIG. 2 is a sectional view along the line 2—2 of FIG. 1.

The invention is shown in a built up blade construction in which a spar 2, extending lengthwise of the blade structure has mounted thereon a shell 4 which, of itself, forms an acceptable airfoil at each section of the blade. As shown, the spar is hollow and approximately a flattened ellipse in section and the shell is also hollow, being made of opposed plates securely attached to the opposite surfaces of the spar in contact therewith and secured together at the edges to form leading and trailing edges 5 and 6. The trailing-edge portion 7 of the shell is shaped to the desired shape for this part of the airfoil shape of the completed blade and the outer surface of the shell is the finished surface of the blade.

Forwardly of the spar the leading edge portion 8 of the shell forms a leading edge airfoil shape, but the shell leading edge 5 is spaced from the blade axis a shorter distance than that of the finished blade shape so that the leading edge portion 8 combines with the trailing edge portion 7 to form a narrower blade structure than the desired blade design shape.

The spar and shell may be either metallic, such as titanium, or may be a composite. In either event, these two elements form the main structure of the blade.

To produce the desired blade leading edge contour a separate primary leading edge element 12 is built up on the leading edge portion 8 of the shell. This leading edge element is constructed of a material that is more frangible than the shell, as for example, layered fiber cloth mesh embedded in a resin and cured as in a suitable mold to produce the desired airfoil shape for the finished blade. The resin also holds the breakable leading edge element securely to the shell. With such a construction, an impact by a large object will break away at least a portion of this breakaway portion without damage to the shell and spar, and normally will break away at the attachment to the shell to expose the secondary leading edge so that the blade is still operable.

Figure 1:
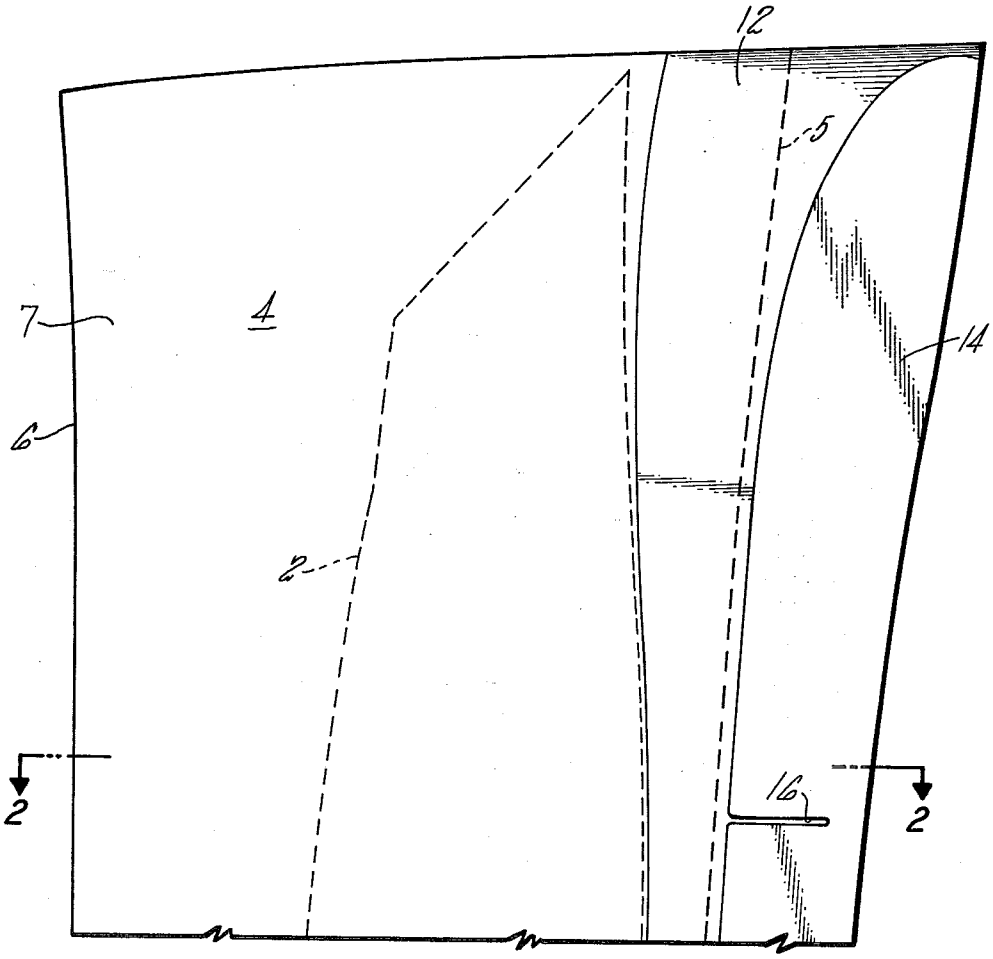
FIG. 1 is a plan view of the tip portion of a fan blade incorporating the invention.

The breakaway portion may be covered at and near its leading edge by a sheath 14 of high-impact material, such as a thin layer of steel to protect against small object impact. This sheath normally protects only a part of the breakaway leading edge element and terminates preferably forwardly of the secondary leading edge 5 as shown in FIG. 1. This sheath may terminate just short of the tip of the blade as shown if desired.

To control to some extent the extent of breakaway in the event of impact, the sheath may have chordwise notches 16 cut in from the back edge toward the leading edge. These notches define zones of breakage for the sheath and thus of the underlying element 12. If desired, the element 12 may also have lines of weakness formed therein, either coincident with the notches 16 or at additional locations for determining the extent of the element 12 that will be broken away. It will also be desirable to assure that the attachment of the element 12 to the shell is such that broken portions of the element 12 will separate from the shell without damage to the configuration of the shell thereby having the secondary leading edge intact. The extent of these weakened or breaking zones is preferably selected so as to control the size of broken pieces of the element 12 and the sheath 14 so as to limit the size of these pieces that may be ingested by the engine.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A fan blade having;

a main blade element having leading and trailing edges and shaped to form airfoil sections, and a primary leading edge section secured to the leading edge of the main element and extending forwardly therefrom, said leading edge section including a protective sheath covering at least a portion of said leading edge portion at its leading edge, said primary leading edge section being shaped to form, with the trailing edge of the main element, primary airfoil sections for the blade, said primary leading edge section being at least in part of a material substantially more frangible than the main element so that said leading edge section may break away in part or in whole and having lines of weakness therein spaced lengthwise of the blade to provide for controlled breakage of the primary leading edge section.

2. A fan blade as in claim 1 in which the primary leading edge section is made in part of fiberglass.

3. A fan blade as in claim 1 in which the attachment of the primary leading edge section to the main element is such that the primary leading edge may break away without damage to the main element.

4. A fan blade having:

a main blade element having leading and trailing edges and being narrower than the blade and a forwardly extending leading edge element extending from the leading edge of the main element and including a protective sheath portion covering at least a part of the leading edge of said leading edge element, and, combined with the main element, establishing the full width of the blade, said leading edge element being in part more frangible than the main element, so that said leading edge element may break away in whole or in part in the event of impact without damage to the main element, said leading edge element having lines of weakness chordwise of the blade and spaced lengthwise of the blade to provide for controlled breakage of the leading edge element in the event of impact.

5. A fan blade as in claim 4 in which the leading edge element cooperates with the main element to form the desired airfoil sections crosswise of the blade, and the lines of weakness are in this sheath portion of the leading edge element and extend chordwise of said portion.

6. A fan blade as in claim 4 in which the leading edge of the main element is shaped to a leading edge to form with the remainder of the main element, effective airfoil shapes crosswise of the blade in the event of breakaway of at least a part of the leading edge element.

7. A fan blade as in claim 4 in which the main element is metallic and the leading edge element is fiberglass.

* * * * *